United States Patent [19]

Kazama et al.

[11] Patent Number: 4,770,966

[45] Date of Patent: Sep. 13, 1988

[54] ELECTROPHOTOGRAPHIC PHOTOSENSITIVE MATERIAL COMPRISING AMORPHOUS CARBON PROTECTIVE LAYER CONTAINING HYDROGEN AND FLUORINE

[75] Inventors: Toyoki Kazama; Koichi Aizawa, both of Yokosuka; Kenichi Hara, Matsumoto; Toshiyuki Iijima, Matsumoto; Yukio Takano, Matsumoto, all of Japan

[73] Assignee: Fuji Electric Co., Ltd., Kawasaki, Japan

[21] Appl. No.: 24,822

[22] Filed: Mar. 12, 1987

[30] Foreign Application Priority Data

Mar. 13, 1986 [JP] Japan ..... 61-55953

[51] Int. Cl.[4] ..... G03G 5/14

[52] U.S. Cl. ..... 430/66; 430/84

[58] Field of Search ..... 430/67, 66, 84

[56] References Cited

U.S. PATENT DOCUMENTS 4,664,999 12/1987 Kakinuma et al. ..... 430/67

*Primary Examiner*—J. David Welsh

*Attorney, Agent, or Firm*—Brumbaugh, Graves, Donohue & Raymond

[57] ABSTRACT

A photosensitive material comprising a photosensitive layer composed of an amorphous silicon-based material formed on an electrically conductive support, and a surface layer formed on said photosensitive layer, the surface layer being composed of amorphous carbon containing hydrogen and fluorine has improved printing durability and humidity resistance.

2 Claims, 2 Drawing Sheets

ELECTROPHOTOGRAPHIC PHOTOSENSITIVE MATERIAL COMPRISING AMORPHOUS CARBON PROTECTIVE LAYER CONTAINING HYDROGEN AND FLUORINE

BACKGROUND OF THE INVENTION

The present invention relates to an electrophotographic photosensitive material having a photosensitive layer composed of an amorphous silicon-based material and a protective layer formed from hydrogen and fluorine containing amorphous carbon.

Photoconductive materials utilizing amorphous silicon containing hydrogen as a matrix material, e,g,, hydrogenated amorphous silicon (a-Si(H)) produced by glow discharge or photo CVD of silane gas ($SiH_4$) have excellent photosensitivity, heat resistance and printing durability, and may be comparatively easily made into a thin film of a great surface area. Furthermore, such films can be formed with little or no fear of environmental contamination. Therefore, amorphous silicon containing hydrogen has recently been attracting attention as a photoconductive material for electrophotographic photosensitive materials.

However, electrophotographic photosensitive materials utilizing such a-Si(H) layer as the surface layer have been frequently found to form poor images when copying is conducted after storage in air or in high humidity for a prolonged time, although they initially give good images. Further, it has been found that prolonged utilization of such photosensitive materials in a copying process gradually causes blurring of the image. Particularly, such heavily used and deteriorated photosensitive materials tend to generate blurring in the image in high humidity, and it has already been confirmed that the critical humidity at which blurring in the image begins to be generated decreases as the number of images copied with the material is increased.

It is presumed that the photosensitive material utilizing a-Si(H) as the surface layer is susceptible to influences on the outermost surface of the photosensitive material by being exposed to air or moisture for a prolonged time or by a chemical species (e,g, ozone, nitrogen oxides, nascent oxygen etc.) generated by corona discharge etc. in the copying process and produces poor images as a result of some chemical change in the properties, but the mechanism of deterioration has not been satisfactorily studied yet. In order to prevent the generation of such poor images and to enhance the printing durability, methods which provide the surface of an a-Si(H) photosensitive material with a protective layer for chemically stabilization have been tried.

For example, a method for preventing the deterioration of a surface layer of a photosensitive material due to a copying process or an environmental atmosphere is known in which hydrogenated amorphous silicon carbide (a-$Si_xC_{l-x}$(H) $0<X<1$) or hydrogenated amorphous silicon nitride (a-$Si_xN_{l-x}$(H)0(X)$<1$) is utilized as a surface protective layer (Japanese Patent Application Laid-open No. 115559/1983 Official Gazette). However, although the printing durability can be considerably improved by selecting the carbon concentration or nitrogen concentration in the surface protective layer at an optimum value, it is impossible to maintain the moisture resistance in a highly humid atmosphere (RH 80% or higher). Furthermore, blurred images are formed by these materials at a relative humidity on the order of 60% when the material has been used for copying several ten thousand sheets. Thus, even if a surface protective layer is provided thereon, it has not been possible to greatly enhance the printing durability and the moisture resistance of a-Si(H) photosensitive materials.

It is therefore an object of the present invention is to provide an a-Si based photosensitive material having excellent durability, printing durability and moisture resistance, which eliminates the above-described drawbacks and having characteristics which are stable. It is a further object of the invention to provide photosensitive material that is not restricted as to the atmosphere in which it can be used. Further, it is an object of the invention to provide photosensitive material that does not suffer from deterioration even on long-term storage or repeated use and that suffers from almost no reduction in the characteristics such as image quality etc. in a highly humid atmosphere.

SUMMARY OF THE INVENTION

The objects of the present invention are achieved by a photosensitive material comprising a photosensitive layer composed of an amorphous silicon-based material formed on an electrically conductive support, and a surface layer formed on said photosensitive layer, the surface layer being composed of amorphous carbon containing hydrogen and fluorine.

DETAILED DESCRIPTION OF THE INVENTION

The photosensitive material of the present invention is described hereinbelow in reference to the drawings.

Figure 1:
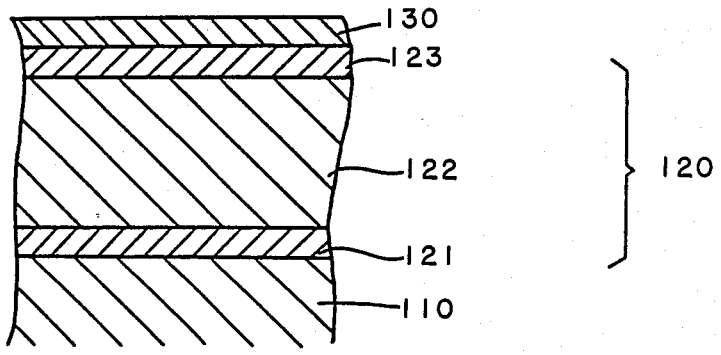
FIG. 1 is a cross-sectional view of a photosensitive material according to the present invention.

FIG. 1 shows an example of the photosensitive material according to the present invention, which is of a constitution of a photosensitive layer 120 and a surface layer 130 laminated on an electrically conductive support 11.

The electrically conductive support 110 may be either cylindrical or sheet-formed, and the material therefor may be a metal such as aluminum or stainless steel, or glass or a resin the surface of which has been processed to be electrically conductive.

The photosensitive layer 120 comprises at least one of hydrogenated amorphous silicon (a-Si(H)), hydrogenated fluorinated amorphous silicon (a-Si(H,F)), hydrogenated amorphous silicon carbide (a-$Si_{l-x}C_x$(H), $(0<X<1)$), hydrogenated fluorinated amorphous silicon carbide (a-$Si_{l-x}C_x$(F,H), $(0<X<1)$), hydrogenated amorphous silicon nitride (a-$SiN_x$(H), $(0<X<4/3)$), hydrogenated fluorinated amorphous silicon nitride (a-$SiN_x$(F,H), $(0<X<4/3)$), hydrogenated amorphous silicon oxide (a-$SiO_x$(H), $(0<X\ 2)$) and hydrogenated fluorinated amorphous silicon oxide (aSi-Ox(F,H), $SiO_x$(F,H), $(0<X<2)$). The film thickness is preferably 5–60 $\mu$m.

Although the photosensitive material according to the invention can be formed having a single uniform photosensitive layer, it is advantageous to provide, as needed, function-separating layers such as a blocking layer 121, a photoconductive layer 122, and a buffer layer 123 within the photosensitive layer 120.

The purpose of the blocking layer 121 is to prevent the inflow of charges from the electrically conductive base 110. The blocking layer can be formed from $Al_2O_3$, AlN, SiO, $SiO_2$, a-$Si_{l-x}C_x$(F,H)($0<X<1$), a-$SiN_x$(H) ($0<X<4/3$), a-C(H), fluorinated amorphous carbon (a-C(F)), a-C(H) and a-C(H,F) doped with elements belonging to the groups III and V of the periodic table, a-Si(H) doped with elements belonging to the groups III and V. The thickness of the blocking layer is preferably thin, such as 1 μm or less.

The photoconductive layer 122 is preferably formed from a material having excellent light absorbing properties and high photoconductivity such as a-Si(H), a-Si(F,H), a-$Si_{1-x}C_x$(H) ($0<X<0.3$), a-$SiN_x$(H) ($0<(-$ $0<X<0.1$), a-$Si_{l-x}Ge_x$(H) and also those doped with elements belonging to the groups III and V of the periodic table. The film thickness is preferably from 3 μm to 60 μm.

The purpose of the buffer layer 123 is to ameliorate the difference in the material quality between the layers closer to the base, e.g., the photoconductive layer 122, and the surface layer 130. Suitable materials for use in the buffer layer include a-$Si_{l-x}C_x$(H) ($0<X<1$), a-$Si_{l-x}C_x$(F,H) ($0<X<1$), a-$SiN_x$(H) ($0<X<4/3$), a-$SiO_x$(H) ($0<X<2$), and a-$SiO_x$(F,H) ($0<X<2$). The film thickness of the buffer layer 123 is determined by balancing the spectral sensitivity, residual voltage, electrical conformity with the adjacent layer etc., and it is preferably not greater than 1 μm.

The surface layer is an amorphous carbon layer containing hydrogen and fluorine (a-C(H,F)), and is fundamentally a film the diffraction image of which by X-rays or electron rays is not clear. Thus, while the amorphous carbon may contain a crystallized part, the percentage of crystallized material is low.

The hydrogen concentration in the a-C(H,F) surface layer can vary from 1 to 60 atomic percent depending on the film forming conditions, and it is desired to make the hydrogen concentration 10–40 atomic percent by appropriately selecting these film forming conditions, namely, the starting gas, the discharge power, the gas flow rate, the gas pressure, the base temperature etc, Further, the optical energy gap, Eg, of the a-C(H,F) surface layer is preferably from 2.2 eV to 3.2 eV; the refractive index is preferably between 1.5 and 2.6; the specific resistance is preferably $10^{11}$–$10^{15}$ Ω-cm; and the density is suitably 1,3 g/cm$^3$ or more.

According to the discovery by the present inventors, the bonding of the hydrogen atoms and the fluorine atoms with the carbon atoms contained in the a-C(H,F) surface layer reflects the bonding of the carbon atoms with each other, and this is one of the factors which decides whether the formed a-C(H,F) layer is effective as the surface layer of the photosensitive material or not. In order that the formed layer be effective as the surface layer, it is necessary that the infrared absorption spectrum include at least absorptions of C-H bonds at 2920 cm$^{-1}$ and 2960 cm$^{-1}$ and absorption of C-F bonds at 1200 cm$^{-1}$.

Where a surface layer composed of amorphous carbon is formed, the adhesion of the film is also of great concern. In the case of amorphous carbon containing hydrogen but no fluorine, the adhesion is not so good if the hydrogen concentration is high. If the hydrogen concentration exceeds 40 atomic percent, this tendency becomes especially remarkable. It is believed that this effect results from combination of hydrogen with the binding sites available for adhesion, and also that the amount of hydrogen present in the film in molecular form is increased and causes cracking. However, when fluorine is added in addition to the hydrogen, the adhesion is greatly enhanced, and even if the hydrogen concentration is as high as 50 atommic percent, a film having good adhesion may be obtained. This effect is believed to be due to the film formation of a surface layer being always achieved on a clean surface as a result of an etching effect on that surface layer by the fluorine. Further, since the H—F bonds are strong, excess hydrogen cannot remain in the film. In addition the inclusion of the fluorine also brings about a reduction in the residual voltage of the photosensitive material, although there the printing durability of the surface layer is somewhat lowered as the fluorine concentration is increased. This is believed to be due to an increase in the chain bonds of —($CF_2$)— such that a film having a resinous nature is generated, The fluorine concentration is preferably in the range of 0.1–5 atomic percent.

The stabilization of the dangling bonds of the amorphous carbon surface may be effected not only with hydrogen and fluorine but also with oxygen and nitrogen. Especially, oxygen is easily applicable because its presence in amounts up to about 5 atomic percent does not greatly interfere with the characteristics of the photosensitive material. Further, the presence of slight amounts of impurities such as B, Al, Si, P, As, Cl, Fe, Ni, Ti, Mn, Mg etc. which are expected to be included during the production process does not cause any problem.

Figure 2:
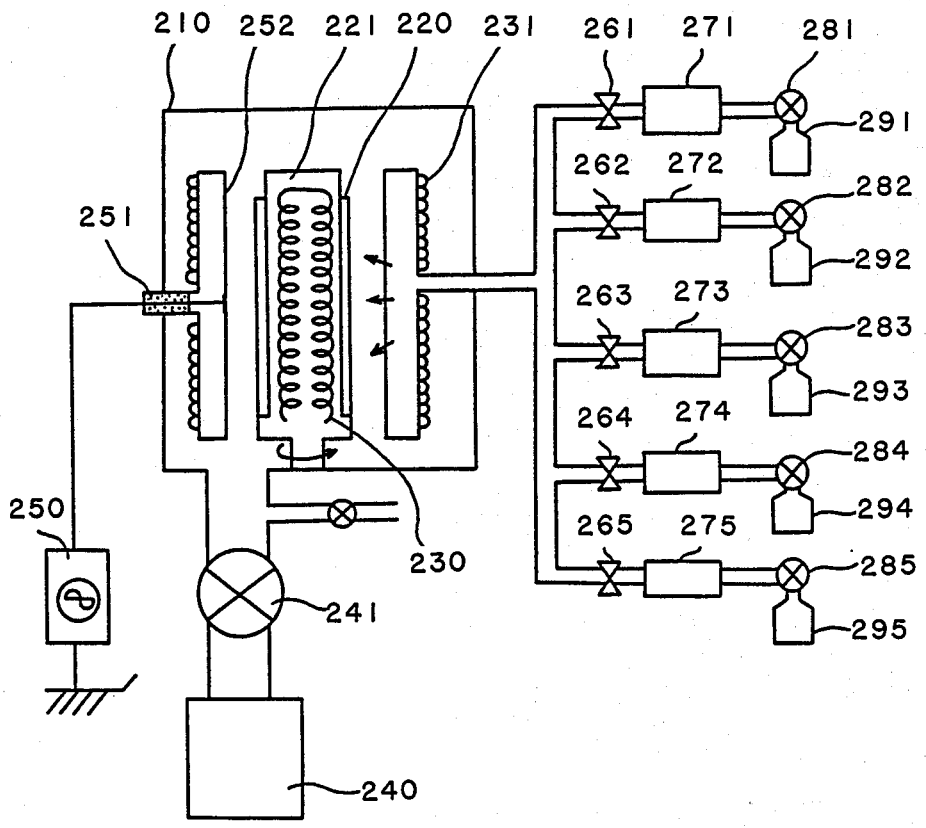
FIG. 2 is a schematic apparatus for use in making photosensitive material according to the present invention.

The production process of the claimed photosensitive material is described in reference to a production device illustrated as a schematic view in FIG. 2. In a vacuum cell 210, an electrically conductive support 220 composed of an aluminum cylinder is fitted to a support holding part 221, and the pressure within the vacuum cell 210 is evacuated to $10^{-6}$ Torr through an evacuating valve 241 by an evacuating pump 240. The temperature of the support 220 is raised to the predetermined temperature, e.g. 50° to 350° C., by a heater 230 within the holding part 221 or heaters 231 in facing electrodes 252, The holding part 221 and the electrically conductive support 220 are rotated to generate film uniformity in the peripheral direction.

Thereafter, among pressure vessels 291–295 for various starting gases necessary for forming the respective layers as described above, a valve of the pressure vessel of the gas necessary for the film formation, e.g. 281, is opened, and the gas is supplied through a flow rate controller 271 to the vacuum cell 210 by opening a stop valve 261. The other gases are supplied in a similar manner. Thereafter, after adjusting the pressure within the cell to the predetermined pressure, e.g. 0.01–5 Torr, a radiofrequency (13.56 MHz) power is applied from a radio frequency (RF) power source 250 to the facing electrodes 252 via an insulating material 251 to generate a glow discharge between the electrodes 252 and the support 220 thereby effecting the film formation.

While FIG. 2 shows five sets of pressure vessels and accessory devices therefor, the number of these sets may be appropriately increased or decreased depending on the number and kinds of gases used.

As the conditions for preparing the a-C(H,F) surface layer, the base temperature is suitably 0° to 200° C., desirably 50° to 150° C., and the energy required for the decomposition of the gas per unit gas volume is desirably 300 J/cc to 20,000 J/cc. The gas pressure is suitably 0.001 to 0.5 Torr, desirably 0.001 to 0.2 Torr. On forming a film, it is also effective for controlling the film properties to apply a bias voltage from outside. Further, in the case of RF discharge, bias is spontaneously generated. This is generally called autobias, and such a bias voltage is suitably +100 to +500 V, and −100 to −1500 V.

Specific examples are given below.

EXAMPLE 1

An aluminum cylindrical support 220 which had been degreased and washed with trichloroethylene was fitted to a holding part 221 within a vacuum cell 210 of a production device in FIG. 2, and a blocking layer 121 having a thickness of 0.2 μm was formed under the following conditions:

| | |
|---|---|
| $SiH_4$ (100%) | Flow rate 250 cc/min |
| $B_2H_6$ (5000 ppm, $H_2$ base) | Flow rate 20 cc/min |
| Gas pressure | 0.5 Torr |
| RF power | 50 W |
| Base temperature | 200° C. |
| Film forming time | 10 min |

Further, a photoconductive layer 122 was formed thereon to a thickness of 25 μm under the following conditions:

| | |
|---|---|
| $SiH_4$ (100%) | Flow rate 200 cc/min |
| $B_2H_6$ (20 ppm, $H_2$ base) | Flow rate 10 cc/min |
| Gas pressure | 1.2 Torr |
| RF power | 300 W |
| Film forming time | 3 hours |

Next, a buffer layer 123 was formed thereon to a thickness of 0.1 μm under the following conditions:

| | |
|---|---|
| $SiH_4$ (100%) | Flow rate 100 cc/min |
| $CH_4$ (100%) | Flow rate 80 cc/min |
| $B_2H_6$ (2000 ppm, $H_2$ base) | Flow rate 15 cc/min |
| Gas pressure | 1.0 Torr |
| RF power | 200 W |
| Base temperature | 200° C. |
| Film forming time | 2 min |

Finally, a surface layer 130 was formed thereon to a thickness of 0.2 μm under the following conditions:

| | |
|---|---|
| Ethylene $C_2H_4$ (100%) | Flow rate 40 cc/min |
| Hexafluoroethane $C_2F_6$ (100%) | Flow rate 3 cc/min |
| Gas pressure | 0.1 Torr |
| RF power | 300 W |
| Base temperature | 110° C. |
| Film forming time | 15 min |

The base temperature was measured by an infrared thermometer and a thermocouple.

The photosensitive material produced as above is designated Sample 1. The energy gap of the photoconductive layer of Sample 1 is 1.8 eV. Further, the composition of the buffer layer is a-$Si_{0.7}C_{0.3}$(H) and its energy gap is 2,1 eV. Furthermore, the energy gap of the surface layer is 2.6 eV, the density is 1.5 g/cm$^3$, the refractive index is 1.9, and the Vickers hardness is 1500 kgf/mm$^2$. The fluorine concentration determined from ESCA was 0.6 atomic percent, and the hydrogen concentration determined by the heat release was 40 atomic percent.

The photosensitive material of Sample 1 was fitted to an ordinary paper copier of the Carlson type, and copying of 50,000 sheets was conducted to obtain extremely sharp images having good resolution. Further, even in a copying test in a different atmosphere after effecting the copying of 50,000 sheets, and also in copying in an atmosphere of a temperature of 35° C. and a relative humidity of 85%, the images were sharp.

For comparison, a photosensitive material lacking only the surface layer was produced according to Example 1, and said comparative photosensitive material was subjected to a copying test after copying 50,000 sheets in a similar manner to find that in copying in an atmosphere of a temperature of 35° C. and a relative humidity of 60%, the image resolving power had been already reduced and blurring in the image had been generated. It can be seen that by forming the surface layer composed of a-C(H,F), the moisture resistance has been greatly enhanced.

In order to form the surface layer, it is not essential to use such gas as $C_2H_4$ or $C_2F_6$, but it is possible to appropriately use in combination a hydrocarbon gas such as $CH_4$, $C_2H_6$, $C_3H_8$, $C_4H_{10}$, $C_2H_2$, $C_6H_6$ etc with a halogenohydrocarbon type gas such as $CF_4$, $C_3F_8$, $CHF_3$ etc.

EXAMPLE 2

Layers up to a buffer layer 123 were formed according to Example 1. A surface layer 130 was then formed thereon, and the gas mixing ratio of $C_2H_4$ *l to* $C_2F_6$ was changed to produce eight photosensitive materials having surface layers with different fluorine contents, which are designated Samples 2–9.

These samples were irradiated with light of a wavelength of 600 nm, and the residual voltage was examined. The results are given in Table 1.

TABLE 1

| | Fluorine Concentration (atomic %). | Residual Voltage (V) |
|---|---|---|
| Sample 2 | 0 | 80 |
| Sample 3 | 0.01 | 75 |
| Sample 4 | 0.1 | 40 |
| Sample 5 | 0.6 | 30 |
| Sample 6 | 3 | 20 |
| Sample 7 | 5 | 20 |
| Sample 8 | 8 | 20 |
| Sample 9 | 18 | 30 |

As is clear from Table 1, the addition of the fluorine to the surface layer is effective for reducing the residual voltage of the photosensitive material, and it can be seen that a fluorine concentration of about 0.1 atomic percent or more is preferred.

Thereafter, these samples were subjected to copying using a dry-type copier of the Carlson type to examine the printing durability, The results thereof are given in Table 2.

TABLE 2

| Sample No. | 2 | 3 | 4 | 5 | 6 | 7 | 8 | 9 |
|---|---|---|---|---|---|---|---|---|
| After copying 10,000 sheets | ⊖ | ○ | ⊖ | ⊖ | ⊖ | ⊖ | ⊖ | ⊖ |
| After copying 20,000 sheets | ⊖ | ⊖ | ⊖ | ⊖ | ⊖ | ⊖ | ⊖ | ○ |
| After copying 30,000 sheets | ⊖ | ⊖ | ⊖ | ⊖ | ⊖ | ⊖ | ○ | Δ |

TABLE 2-continued

| Sample No. | 2 | 3 | 4 | 5 | 6 | 7 | 8 | 9 |
|---|---|---|---|---|---|---|---|---|
| After copying 50,000 sheets | ⊖ | ⊖ | ⊖ | ⊖ | ⊖ | ⊖ | Δ | X |
| After copying 100,000 sheets | ⊖ | ⊖ | ⊖ | ⊖ | ⊖ | ○ | Δ | — |

Copying was conducted in an atmosphere of a temperature of 30° C. and a relative humidity of 60%. After copying 10,000 sheets, 20,000 sheets, 30,000 sheets, 50,000 sheets and 100,000 sheets, the copied images were examined and judged. In Table 2, the mark ⊖ indicates that extremely sharp images were obtained; the mark ○ indicates that the images were acceptable for practical use; the mark Δ indicates that the images generated were blurred to some extent; and the mark X indicates that blurring in the image was generated to a great extent. It can be seen from Table 2 that with an increase in the fluorine concentration in the surface layer, the printing durability is lowered and the amount of the surface abraded by copying is increased and thus the image quality of the copied images is deteriorated. This can also be expected from the observation that with an increase in the fluorine concentration in the surface layer, the infrared absorption by $CF_2$ in the vicinity of 1200 $cm^{-1}$ is increased. It is presumed that when the chain bonds of—$(CF_2)$—are increased in number, the film becomes resinous and thus the hardness is lowered and the susceptibility to abrasion is increased. Therefore, the preferred value for the fluorine concentration in the surface layer is 5 atomic percent or less.

According to the present invention, by providing a surface layer composed of amorphous carbon containing hydrogen and fluorine on the surface of a photosensitive layer composed of an a-Si-based material, there may be obtained a stable electrophotographic photosensitive material which has excellent photosensitive characteristics, especially has a low residual voltage, excellent durability, moisture resistance and printing durability, and which does not suffer fatigue or deterioration even when stored for a prolonged time or used repeatedly.

We claim:

1. An electrophotographic photosensitive material comprising in sequence:

(a) a conductive support;

(b) a photosensitive layer comprising amorphous silicon; and (c) a surface protective layer comprising amorphous carbon containing 40 to 60 atomic percent hydrogen and 0.1 to 5 atomic percent fluorine.

2. A method of improving adhesion of an amorphous carbon layer containing hydrogen to an adjacent silicon layer in an electrophotographic photosensitive material which comprises adding 0.1 to 5 atomic percent fluorine to the amorphous carbon layer.

* * * * *